US006213918B1

(12) United States Patent
Rogers, Jr.

(10) Patent No.: US 6,213,918 B1
(45) Date of Patent: Apr. 10, 2001

(54) METHOD AND APPARATUS FOR FINGER, HAND AND WRIST THERAPY

(75) Inventor: Eddie C. Rogers, Jr., Montgomery, AL (US)

(73) Assignee: Patent/Marketing Concepts, L.L.C., Boaz, AL (US)

( * ) Notice: Subject to any disclaimer, the term of this patent is extended or adjusted under 35 U.S.C. 154(b) by 0 days.

(21) Appl. No.: 09/192,936

(22) Filed: Nov. 16, 1998

(51) Int. Cl.[7] ..... A63B 23/16; A63B 21/055

(52) U.S. Cl. ..... 482/44; 482/47; 482/48; 482/124; 601/40

(58) Field of Search ..... 482/44, 47–49, 482/121, 129, 148, 907, 124; 601/40; 602/21, 22; 273/282.1; 84/465, 467–469; D21/684

(56) References Cited

U.S. PATENT DOCUMENTS

| | | | | |
|---|---|---|---|---|
| D. 383,607 | * | 9/1997 | Whitlock | D3/305 |
| 530,669 | * | 12/1894 | Strong | 482/48 |
| 638,632 | * | 12/1899 | Griffin | 482/48 |
| 1,301,560 | | 4/1919 | Hill . | |
| 1,879,401 | | 9/1932 | Monaco . | |
| 3,606,316 | * | 9/1971 | Krewer | 482/47 |
| 3,871,646 | | 3/1975 | Slack . | |
| 4,105,200 | | 8/1978 | Unger . | |
| 4,750,734 | * | 6/1988 | Greenfield | 482/47 |
| 4,822,027 | * | 4/1989 | Kascak | 604/40 |
| 4,836,531 | | 6/1989 | Niks . | |
| 4,979,749 | * | 12/1990 | Onaian | 273/282.1 |
| 5,303,696 | | 4/1994 | Boice . | |
| 5,366,436 | | 11/1994 | Gibney . | |
| 5,374,226 | | 12/1994 | Grahm . | |
| 5,445,582 | | 8/1995 | Brown . | |
| 5,514,052 | | 5/1996 | Charles et al. . | |
| 5,573,479 | | 11/1996 | Harris . | |
| 5,639,090 | * | 6/1997 | Stevens | 273/287 |
| 5,673,803 | * | 10/1997 | Burbank | 211/87.01 |
| 5,723,785 | * | 3/1998 | Manning | 482/48 |

FOREIGN PATENT DOCUMENTS

| | | | | |
|---|---|---|---|---|
| 2424449 | * | 12/1975 | (DE) | 482/47 |

OTHER PUBLICATIONS

String Drawing Board, Sportime Abilitations Spring 1995 catalog, p. 51, item # 1065802–S5.*

* cited by examiner

*Primary Examiner*—Everett Williams
*Assistant Examiner*—Victor Hwang
(74) *Attorney, Agent, or Firm*—Dowell & Dowell, P.C.

(57) ABSTRACT

A method and apparatus to strengthen an individual hands, fingers and wrists includes at least one resilient band supported by at least one of a plurality of spaced pegs which extend from at least one side of a support base and wherein resistance of the at least one resilient band to manipulation by the fingers and hands is used to exercise and strengthen muscles of the hands and wrists.

8 Claims, 3 Drawing Sheets

METHOD AND APPARATUS FOR FINGER, HAND AND WRIST THERAPY

BACKGROUND OF THE INVENTION

1. Field of the Invention

This invention is generally directed to exercise and therapeutic devices of the type utilized for muscle strengthening and more particular to portable devices which are constructed to permit therapy and strengthening of the fingers, hands and wrist of an individual and which use resilient bands to provide resistance to joint manipulation.

2. History of the Related Art

Loss of strength in an individual's fingers, hands and wrist can occur from a variety of factors such as; repeated finger movements resulting in carpel tunnel syndrome, as a result of a stroke, arthritis, or tendinitis, or due to finger injury or amputation. Not only is loss of strength a problem but often severe discomfort and pain accompanies the condition. Without proper rehabilitation therapy, such conditions may result in the necessity for surgery followed by expensive and extensive physical therapy in order to maintain even a small percentage of the original hand and wrist strength.

Some prior art therapeutic devices involve the use of objects which can be squeezed such as balls which are held in the patient's hand with patient being instructed to apply increasing pressure to the surface of the ball to provide increasing amounts of resistance to the flexing of the fingers. Unfortunately, such an exercise device only provides for resistance in one motion of the fingers closing relative to the palm in flexion and does not provide for necessary exercise for finger extension and finger movement relative to the plane of the palm of the hand. It is important, to provide total rehabilitation, to ensure that the joints of the hand, fingers and wrist are manipulated in all directions so that maximum strength and dexterity can be achieved through appropriate therapy and exercise.

In U.S. Pat. No. 4,105,200 to Unger a hand and finger exercise device is disclosed which includes a central cylinder which is adapted to be engaged in a person's hand. A plurality of elastic straps extend along the length of the cylinder and over the fingers and a separate strap extends along only a portion of the cylinder for engaging over the thumb. In use, an individual squeezes on the cylinder and thereafter flexes the fingers or thumb outwardly against the resilient elements. Unfortunately, with this type of device, the resistance to flexing of the fingers inwardly can not be adjusted as the cylinder is substantially rigid. Also, the degree of resistance to outward flexing of the fingers can not be adjusted. In addition, the straps provide uniform resistance to the movement of the fingers and do not therefore provide relative resistance depending upon which finger is being exercised.

In U.S. Pat. No. 5,366,436 to Gibney, a non-invasive method for treating carpal tunnel syndrome is disclosed which includes an elastomeric sheet having a plurality of holes therein for receiving the tips of the fingers and thumb. This sheet is designed to provide resistance axially outwardly from a center portion of the sheet thus drawing the fingers and thumb toward the center. With this type of device, the primary resistance is only in a single direction and the resistance in flexion and tension can not be adjusted. The device is designed to provide for outwardly flexing of the fingers but does not otherwise provide resistance for inward movement, flexion, of the fingers.

Other prior art patents for increasing strength and providing flexibility of the hand are disclosed in U.S. Pat. Nos. 3,871,646 to Slack, 4,836,531 to Niks, 5,303,696 to Boice, 5,514,052 to Charles et al., 5,374,226 to Graham, 5,445,582 to Brown and 5,573,479 to Harris.

SUMMARY OF THE INVENTION

The present invention is directed to a method and device for providing exercise for rehabilitation of an individual's fingers, hands and wrist so as to achieve maximum dexterity at each of the joints and thereby relieve individual discomfort and increase muscle strength to permit normal use of the hand. The invention includes a support base having opposite sides and, from at least one side extend, a plurality of pegs. In one embodiment the pegs are spaced in a somewhat circular orientation relative to one another and define a central area over which an individual's palm may be positioned. In a second embodiment, the pegs are situated along an arc of a circle and the base has an extension for mounting to the wrist.

In the first embodiment the pegs of the invention support at least one resilient band which is placed under tension by being placed around the periphery of the spaced pegs. The number of resilient bands may be increased to provide additional resistance to finger and hand movements. The pegs are spaced such that the fingers of an individual's hand can engage segments of at least one resilient band intermediate the spaced pegs. In some embodiments, the spacing between the pegs may be varied such that each segment of the at least one resilient band offers differing resistance to movement depending upon which finger is to engage a particular segment of the resilient band.

Also, in some embodiments, the pegs are mounted so as to extend outwardly from each of the opposite sides of the support base. In such embodiments, a plurality of openings may be formed in the base through which the pegs extend such that the end portions of the pegs are positioned outwardly on opposite sides of the support base. One or more resilient bands may be placed on opposite ends of the pegs on opposite sides of the support base so that the fingers, hands and/or wrists may be simultaneously or alternately exercised.

In the second embodiment, separate resilient bands are engaged or supported by each of the pegs such that an individual's fingers are engageable with the separate resilient bands when the individual's hand is placed on an adjacent support base.

In accordance with the methodologies of the present invention, an individual may use the devices of the first and second embodiments to exercise the muscles of the hands and wrist to achieve maximum strength and dexterity. With the first embodiment of the invention, in a first position, an individual positions their palm over the central portion of the apparatus with their fingers extending outwardly overlapping segments of the resilient band and thereafter squeeze the band as if attempting to pick up an object on the support base. By placing the fingers within the resilient bands and then pushing outward, a further strengthening of the muscles of the hand may be obtained in extension. The resilient bands may also be used to strengthen the grip between the thumbs and forefingers by pulling on the band or bands to pull or lift the bands from engagement with the pegs.

In the second embodiment of the invention, an individual places the wrist and hand against the support and secures the support base to the wrist and hand utilizing a strap. Prior to tightening the strap, the fingers are inserted within the bands extending from each of the pegs so that the fingers may be flexed thereby pulling against the resilient bands. To further exercise the wrist, the back of the hand is placed against the support base with the fingers extending beneath the resilient band. Thereafter the individual pivots their hand upwardly against the resilient bands to create a flexing motion at the wrist which is resisted by the bands. With either embodiment, the number of bands is varied to increase or decrease the amount of resistance to either finger or hand movement.

It is the primary object of the present invention to provide a therapeutic device which is low cost and portable and which may be used to exercise the fingers, hands and wrist to strengthen the muscles associated therewith.

It is another object of the present invention to provide a therapeutic exercise device which can be utilized for strengthening the muscles associated with the hand and wrist and which can be easily adjusted to vary the resistance to joint movement by increasing or decreasing the number of elastic bands associated therewith.

It is also an object of the present invention to provide an exercise device which is compact and which may be disassembled for storage and easily assembled for use and which utilizes easily obtainable elastic bands, such as rubber bands, for purposes of providing necessary resistance to motion to provide therapeutic treatment.

DESCRIPTION OF THE PREFERRED EMBODIMENT

Figure 1:
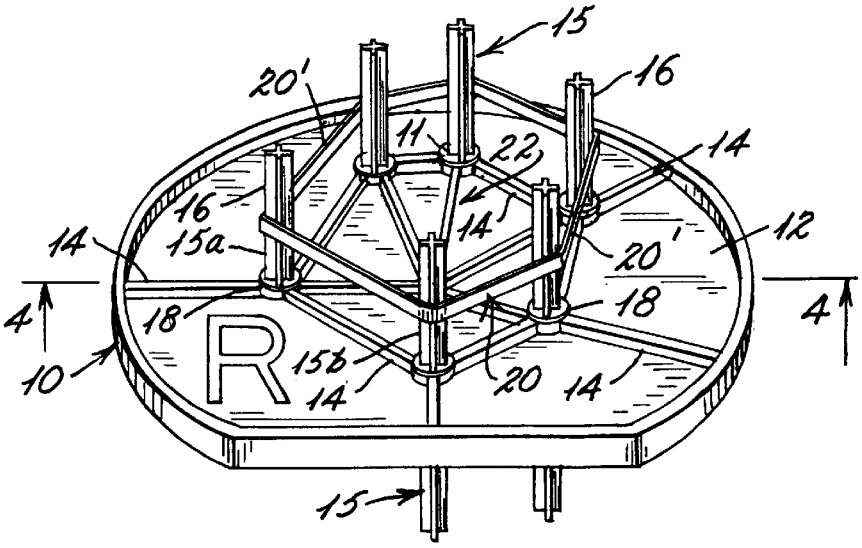
FIG. 1 is a top perspective view of a first embodiment of the present invention.
Figure 2:
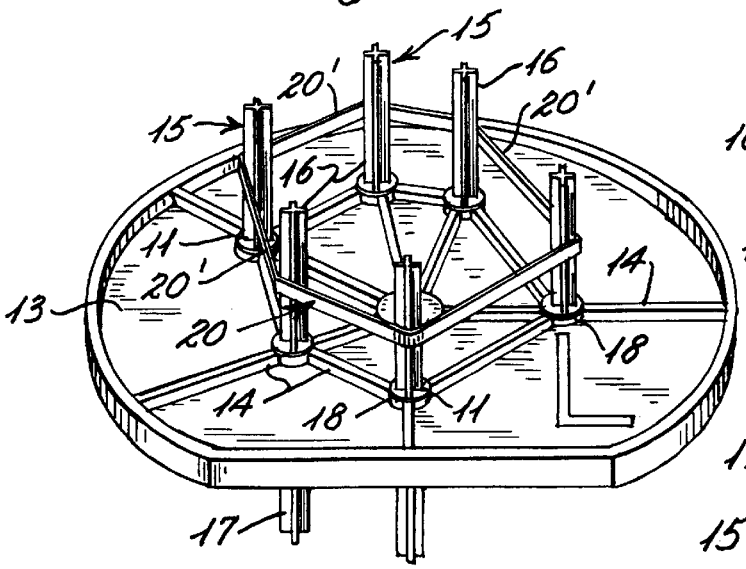
FIG. 2 is a bottom perspective view of the embodiment of FIG. 1.
Figure 3:
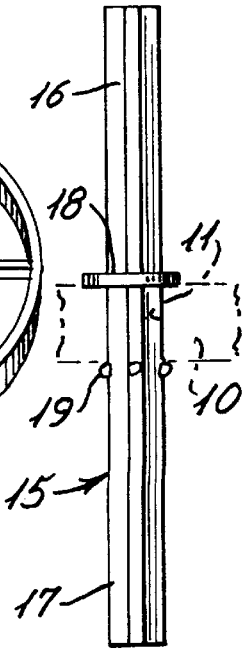
FIG. 3 is an enlarged front plan illustrational view showing one of the pegs of the invention locked in seated engagement within an opening in a support base.

With continued reference to the drawing figures, the present invention includes a generally planar base member 10 having a plurality of openings 11 therein which extend from the upper surface 12 to the lower surface 13 thereof. The openings may be reinforced with respect to the body of the base 10 by providing a plurality of interconnecting ribs 14 which may be integrally molded of a plastic material from which the base is preferably made. Other materials may be utilized in the construction of the device.

Figure 4:
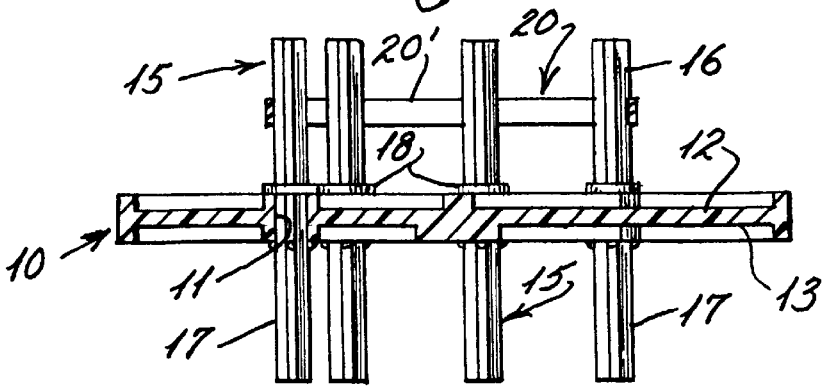
FIG. 4 is a cross-sectional view, in a reduced scale, taken along lines 4—4 of FIG. 1.

As shown in drawing FIG. 1, the openings are spaced at different distances relative to adjacent openings which spacing is preferably predetermined based upon factors which will be described in greater detail hereinafter and the openings together define a somewhat circular shape. The openings are of a size to receive elongated pegs 15 which extend through the openings so as to have a first segment 16 extending outwardly from side 12 of the base and a second segment 17 extending from the opposite side 13 of the base. The pegs 15 are provided with integrally formed flanges 18 which are of size to abut the base 10 adjacent the openings 11 to prevent the pegs from being urged completely through the openings. Further, locking nubs 19 may be integrally molded in spaced relationship to the flanges so that the nubs engage one side of the base while the flanges engage an opposite side of the base as shown in FIG. 4. The nubs permit the pegs to be urged through the openings and then snap fit the pegs in place.

At least one resilient band 20, such as a convention rubber band, is mounted on or supported by the segment 16 of the pegs 15 so as to be in spaced relationship with respect to the base 10. At least one resilient band 20 is utilized with the segment 16, however, additional bands may be added to provide additional resistance for the therapeutic treatment of an individual, as will be discussed in greater detail hereinafter. The band 20 is placed about the outer periphery defined by the peg segments 16 and thereby defines an inner area 22 which is preferably of a size generally equal to the palm of an individual's hand. In this respect, two of the pegs 15*a* and 15*b*, may be spaced at a distance which will permit the wrist of an individual to be positioned therebetween so that the back of the hand or the palm of the hand may be seated within the area 22 defined within the perimeter of the pegs 15.

Figure 5:
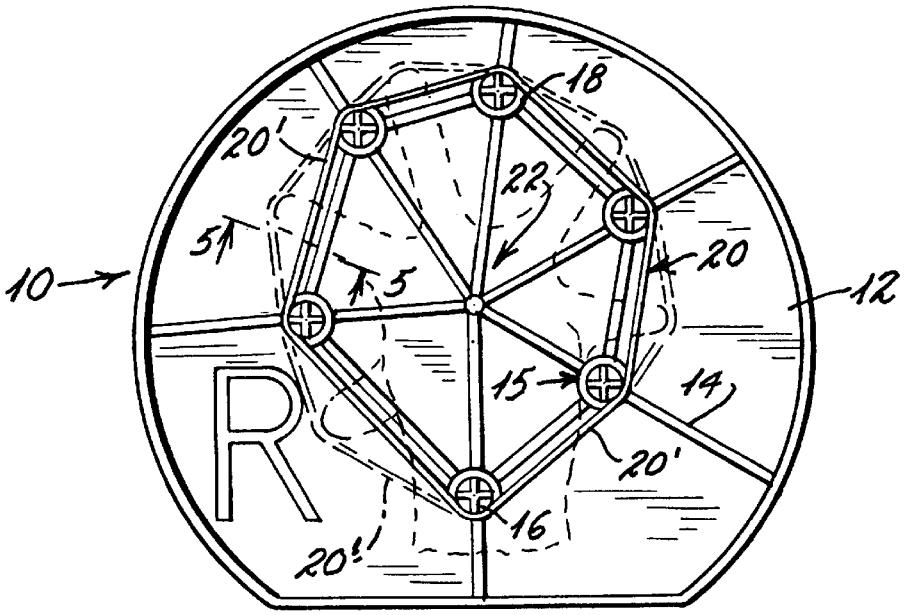
FIG. 5 is a top illustrational view showing a person's hand in dotted line engaging a band in extension.
Figure 7:
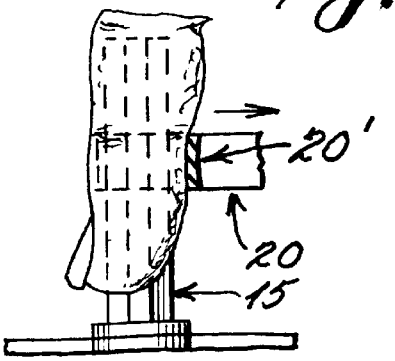
FIG. 7 is a partial illustrational view taken along lines 55—5 of FIG. 5 showing relative finger movement in flexion.

When an individual places the palm of the hand in opposing relationship with respect to the base, as shown in FIG. 5, the outer appendages of the fingers may be extended over the elastic band 20, as shown in FIG. 7, and thereafter the fingers drawn inwardly in flexion, such as to grasp an imaginary object which would be spaced between the individual's palm and the base 10. Exercise is accomplished by first engaging the band with the outer most finger appendage and, after repeated squeezing motions, engaging the rubber band with the next inner segments of the fingers and repeating the exercise movement. Further repetitions may be made by engaging the band with the inner joint of the fingers and performing the same squeezing repetitions. The number of repetitions and the amount of resistance provided by the band or bands 20 will depend on the ability of the individual to effectively squeeze the bands and the amount of resistance which is necessary to obtain a good therapeutic effect to build sufficient hand strength.

Figure 6:
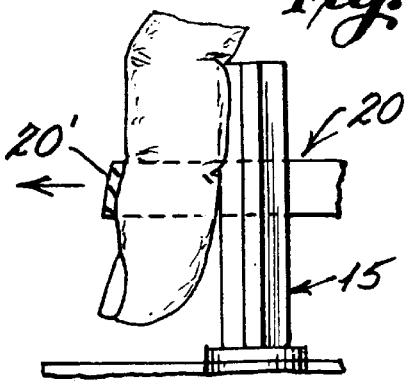
FIG. 6 is a partial illustrational view taken along line 5—5 of FIG. 5 showing relative finger movement in extension.

Further exercise of the hand and fingers is obtained by placing the fingers within the elastic band or bands 20 and thereafter urging or pushing the fingers outwardly against the resistance of the band to extend the fingers in extension, as shown in FIG. 6. In this manner, the therapeutic exercise device of the present invention can be utilized to strength the muscles both in flexion and extension.

With respect to FIG. 1, it is noted that the letter "R" has been molded into the surface between the peg elements 15*a* and 15*b*. The designation "R" is a guide for the patient to place the right thumb into engagement with a segment 20' of the band between the pegs 15*a* and 15*b* and thereafter place the other fingers between other segments 20' of the bands between the other pegs 15. Usually, only one finger is placed between each set of pegs, however, in some instances, two or more fingers may be placed between a single set of pegs to provide a variation in the flexion and extension motion of the muscles associated with the hand. This will further increase overall dexterity of the hand through the strengthening exercises.

As shown in the embodiment of FIGS. 1–7, a second band 20 or bands is applied to segments 17 extending from the opposite side 13 of the base 10. In this manner, the side marked with the letter "R" may be utilized for exercise of the fingers of the right hand while the opposite side marked with the letter "L" may be used to simultaneously exercise the fingers of the left hand. In this embodiment, the apparatus is designed to be supported between the individual's hands as opposed to be supported on a support surface. The letter "L" has been molded on surface 13 to designate the positioning of the left thumb when the individual places their hand within the elastic band 20.

Although not shown in the drawings, only a single set of spaced pegs or peg segments 16 or 17 may be used on only one side of the base of the invention. Further, the pegs need not be structured to extend through openings 18 and the segments 16 and 17 of the pegs may be integrally molded or otherwise secured to extend outwardly relative to the base 10.

As previously mentioned, the spacing or distance between the openings 11 and thus the adjacent peg segments 16 and 17 may be varied. As the strength characteristics of each of the finger muscles of a hand are different, by varying the spacing between the segments, the amount of resistance provided by each segment 20' of the resilient bands may be varied such that a lesser resistance is provided against the third finger than the second finger and so on. Relative spacing may be determined and varied for different types of therapeutic treatment and depending upon a patient's needs.

In the use of the first embodiment of the invention, the pegs are inserted through the openings 18 and snap fitted therein. Thereafter, rubber or other resilient bands are placed around the pegs. Increasing the number of bands increases the resistance to promote additional strength. The thumb of the left or right hand is engaged adjacent the marking "L" or "R" molded into the surface of the base. By placing the palm of the hand over the central portion of the base within the peg elements, the individual squeezes the fingers as if picking up something from inside the pegs. The number of repetitions of such squeezing will vary depending upon the individual's strength and preferably the number of repetitions will be increased over a period of time. Thereafter, the individual places the fingers inside of the resilient bands and pushes outwardly against the bands in extension. This exercise is also repeat a predetermined number of times.

To further provide for increase manual dexterity, the individual may pinch the rubber or other resilient bands between a thumb and forefinger and thereafter pull the band outwardly lifting the bands from the pegs.

Once an exercise program has been completed, the invention may be easily disassembled by removing the pegs from the openings in the base and the apparatus compactly stored for future use.

Figure 9:
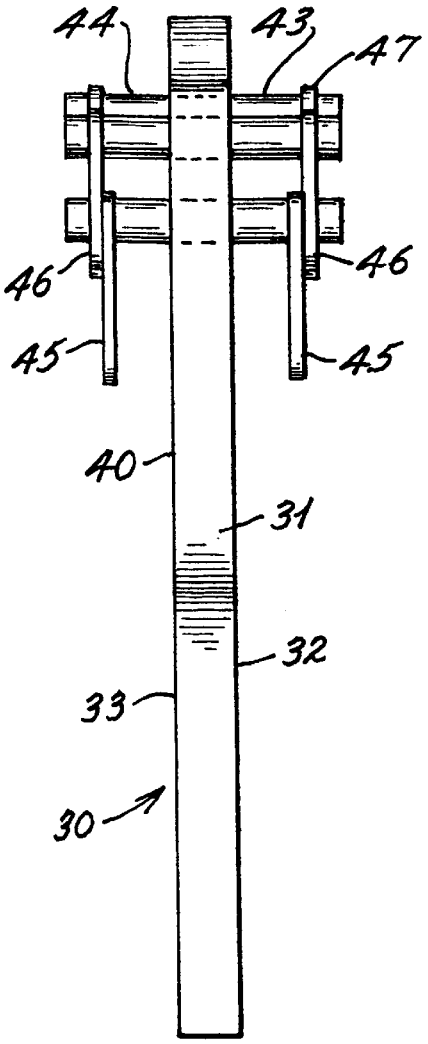
FIG. 9 is a left side elevational view of the embodiment of FIG. 8.
Figure 8:
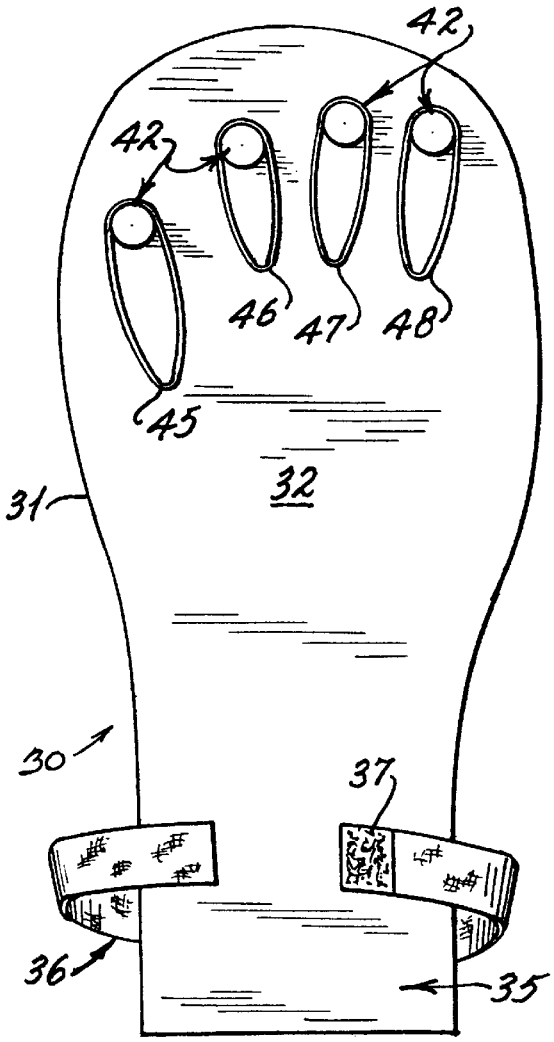
FIG. 8 is a top plan view of a second embodiment of the present invention.

With specific reference to FIGS. 8 and 9, a second embodiment of the invention is disclosed in greater detail. In this embodiment, the exercise device 30 includes a base support member 31 having an upper surface 32 and a lower surface 33. The base includes an enlarged end portion 34 which is designed to be of a size to support an individual's hand, either palm side down or palm side up, and an extension portion 35 which is designed to extend beneath the individual's wrist. The exercise device 30 is designed to be secured adjacent the wrist utilizing a strap 36 having opposing hook and loop fastening elements 37 associated therewith.

A plurality of openings 40 are provided through the enlarged end portion 34 of the base member and are generally aligned along an arc of a circle and are spaced relative to one another so as to be generally aligned with an individual's fingers. A plurality of spaced pegs 42 are mounted within the openings 40 and have upper segments 43 extending above the upper surface 32 and lower segments 44 extending below the lower surface 33. The pegs are of the type described with respect to the previous embodiment and may include the same flange and nub elements, although not shown in the drawing figures. As with the previous embodiment, only a single set of pegs may be provided extending from one surface of the exercise device, however, in the preferred embodiment, the pegs extend outwardly on opposite sides. Further, the pegs may be integrally formed or molded with the base member as opposed to being separate inserted members as shown in the drawing figures.

In this embodiment, separate resilient bands 45, 46, 47 and 48 are engaged or supported by each of the spaced pegs. Additional bands may be used to provide additional resistance for exercising in a manner similar to that discussed with respect to the previous embodiment.

In use, the individual places their hand against the enlarged end portion of the device while extending the fingers within the bands such that the finger tips are positioned between the bands and pegs. Thereafter the strap is secured about the individual's wrist. By curling the fingers in flexion, the fingers muscles are exercised in a first manner. By curling the wrist in this position, the wrist becomes exercised. By reversing the orientation of the individual's hand, such as the palm direction, the fingers may again be engaged against the elastic bands and are flexed in a pulling motion.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. An apparatus for the therapeutic treatment, exercise and strengthening of an individual's hand and wrist comprising, a support base having opposite surfaces, a plurality of pegs extending from each of said surfaces of said support base in spaced relationship to one another and arranged in a pattern about a central area and being spaced from one another a distance at least sufficient to permit an individual's finger to pass therebetween with said central area being of a size to receive an individual's hand therein, and at least a resilient band supported in tension about and by said pegs adjacent each of said opposite surfaces such that said resilient bands surround said central areas of said opposite surfaces, whereby segments of said resilient bands between said plurality of pegs are engageable by and supply resistance to movement in flexion and extension of fingers of the individual's hand when the individual's hand is positioned within one of said central areas of one of said opposite surface.

2. The apparatus of claim 1 wherein two of said plurality of pegs are spaced at a greater distance with respect to one another on each of said opposite surfaces of said support base than distances between the other of said plurality of pegs.

3. The apparatus of claim 1 wherein said plurality of pegs are spaced at varying distances with respect to one another such that said segments of said resilient bands provide different resistances to manipulation.

4. The apparatus of claim 3 wherein at least two of said plurality of pegs are spaced at a greater distance with respect to one another than distance to thereby permit the individual's wrist to be extended therebetween on each of said opposite surfaces of said support base.

5. The apparatus of claim 1 including a plurality of spaced openings through said support base, and said plurality of pegs extending through said openings so as to extend outwardly of each of said opposite surfaces of said support base.

6. The apparatus of claim 5 wherein said plurality of pegs include an intermediate flange for engaging said support base adjacent said openings, and each of said plurality of pegs including a nub spaced from said intermediate flange so as to engage said support base on a surface opposite a surface engaged by said intermediate flange.

7. An apparatus for the therapeutic treatment, exercise and strengthening of an individual's hands and wrists comprising, a support base having opposite surfaces, a plurality of spaced pegs extending outwardly from said opposite surfaces of said support base, said pegs being spaced in a generally circular relationship with respect to one another and extending from each of said opposite surfaces of said support base, and around central areas of each of said surfaces and resilient bands supported by said pegs adjacent each of said opposite surfaces of said support base whereby said bands are engageable by an individual's fingers to thereby provide resistance to finger movement when an individual's hands are positioned along said central areas of said support base.

8. The apparatus of claim 7 wherein said pegs are spaced at varying distances with respect to one another extending from said opposite surfaces of said support base whereby segments of said resilient bands provide different resistance to manipulation by an individual's fingers.

* * * * *